US005836129A

United States Patent [19]

Jaecklin

[11] Patent Number: 5,836,129

[45] Date of Patent: Nov. 17, 1998

[54] CONSTRUCTION ELEMENT, IN PARTICULAR SUPPORTING OR SOUND INSULATING CONSTRUCTION ELEMENT CAPABLE OF BEING PLANTED, SET OF CONSTRUCTION ELEMENTS AND PROCESS FOR PRODUCING THE SAME

[76] Inventor: Felix Paul Jaecklin, Geissbergstrasse, CH-5400 Ennetbaden, Switzerland

[21] Appl. No.: 428,250

[22] PCT Filed: Sep. 1, 1994

[86] PCT No.: PCT/EP94/02907

§ 371 Date: Oct. 6, 1995

§ 102(e) Date: Oct. 6, 1995

[87] PCT Pub. No.: WO95/06783

PCT Pub. Date: Mar. 9, 1995

[30] Foreign Application Priority Data

Sep. 1, 1993 [DE] Germany ..... 43 29 370.0

[51] Int. Cl.[6] ..... E02D 5/00; E02D 17/20

[52] U.S. Cl. ..... 52/612; 47/56; 47/83; 52/596; 52/600; 52/610; 52/745.19; 405/258; 405/284

[58] Field of Search ..... 47/56, 83; 52/309.9, 52/309.14, 406.1, 406.2, 404.1, 576, 596, 600, 604, 608, 609, 610, 612, 721.4, 723.1, 724.5, 736.3, 737.4, 738.1, DIG. 9, 745.19; 405/262, 258, 272, 284, 285, 286, 273

[56] References Cited

U.S. PATENT DOCUMENTS

| | | | |
|---|---|---|---|
| 1,047,464 | 12/1912 | Tirapani | 405/273 |
| 1,544,478 | 6/1925 | Payne | 52/600 |
| 1,794,572 | 3/1931 | Wyatt | 52/596 |
| 2,113,523 | 4/1938 | White | 47/83 X |
| 2,313,363 | 3/1943 | Schmitt | 52/596 X |
| 3,390,505 | 7/1968 | Dockerty | 52/596 |
| 4,293,245 | 10/1981 | Jaecklin | 405/284 X |
| 4,655,637 | 4/1987 | Vignocchi | 405/258 X |
| 4,818,150 | 4/1989 | Jaecklin | 405/258 X |
| 4,856,939 | 8/1989 | Hilfiker | 405/258 X |
| 4,904,124 | 2/1990 | Egan | 405/258 X |
| 4,930,939 | 6/1990 | Jaecklin | 405/258 X |
| 5,017,050 | 5/1991 | Jaecklin | 47/83 X |
| 5,066,169 | 11/1991 | Gavin et al. | 405/284 |
| 5,076,735 | 12/1991 | Hilfiker | 405/258 X |
| 5,139,369 | 8/1992 | Jaecklin | 47/83 X |
| 5,156,496 | 10/1992 | Vidal et al. | 405/258 X |
| 5,181,351 | 1/1993 | Jaecklin | 47/83 X |
| 5,257,476 | 11/1993 | Fukuzumi | 47/83 |
| 5,333,970 | 8/1994 | Heselden | 405/286 |
| 5,419,092 | 5/1995 | Jaecklin | 405/284 X |

FOREIGN PATENT DOCUMENTS

| | | | |
|---|---|---|---|
| 25123 | 2/1991 | Japan | 47/83 |

*Primary Examiner*—Carl D. Friedmen
*Assistant Examiner*—Kevin D. Wilkens
*Attorney, Agent, or Firm*—Tarolli, Sundheim, Covell, Tummino & Szabo

[57] ABSTRACT

A construction element, such as a supporting element for a retaining wall, has a casing which is at least partially permeable. The casing contains a block-shaped, granulated, bulk or porous filling material. The casing has two layers including a relatively rigid grating part (GT) for strength and a relatively flexible, finer meshed netting part (NT) for containment of filling material. The casing is designed as a closed hollow body which is coupled to the filling (FL) so as to form a substantially self-supporting construction element which is completely prefabricated.

13 Claims, 11 Drawing Sheets

Figure 1:
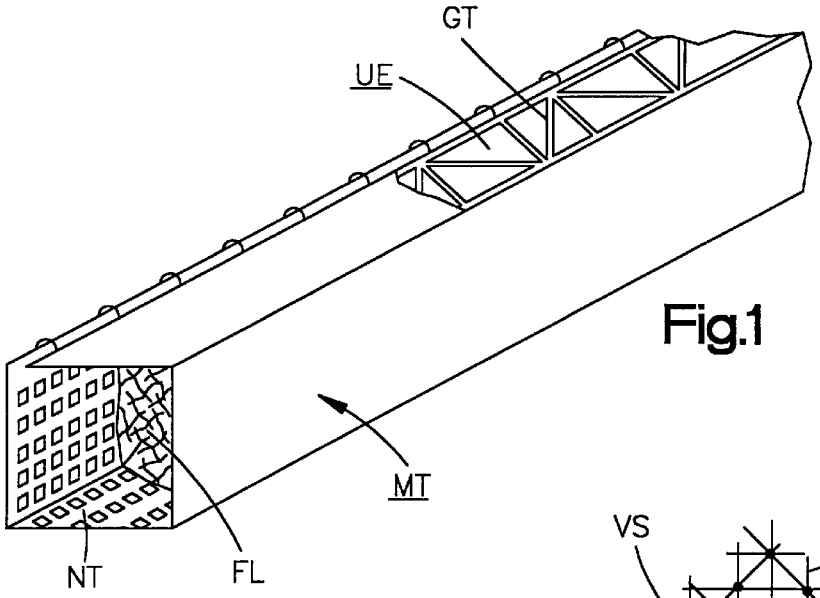

CONSTRUCTION ELEMENT, IN PARTICULAR SUPPORTING OR SOUND INSULATING CONSTRUCTION ELEMENT CAPABLE OF BEING PLANTED, SET OF CONSTRUCTION ELEMENTS AND PROCESS FOR PRODUCING THE SAME

The invention relates to an element for structures, in particular for greenable supporting or sound-proofing structures, The invention furthermore relates to a relevant set of structural parts as well as to a structure made with such structural parts or sets of structural parts, and to a process for the production of structural elements and structures of the said type.

Structural elements of the aforementioned type are generally known as gabions comprising a casing part made of comparatively large-meshed wire grating and a filling of a suitably coarse, generally block-like rock material. Layered on top of one another, these elements are used for retaining walls with a low height. They are susceptible to damage and in the long run to corrosion of the front, exposed grating, as a result of which the stability and supporting affect are adversely affected or undone. A greening is possible only when in addition suitable soil is put on. The production is complicated, in particular because of the requirements in respect of the grain or block size and quality of the rock material.

Furthermore, from the EP 0 197 000 B1 a structural element is known with a U-shaped grate casing open at the back, which is lined with a geotextile through which plants can grow. Inside the casing a soil suitable for greening is provided. When using such structural elements, the supporting filling must be put into position and possibly compacted during the construction of the wall, after the individual casing parts have been put in place. This makes the production complicated. Moreover, unless a high-quality material is used for the filling, also the carrying capacity is limited due to the substantially open back part.

The object of the invention, therefore, is the creating of structural elements, a corresponding set of structural parts and of structures, as well as corresponding production processes, which permit a simple and uncomplicated production or process implementation, a high carrying capacity as well as, if desired, an intensive greening.

Figure 2:
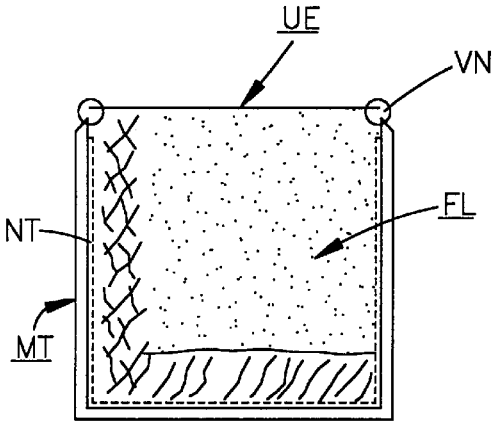
Figure 3:
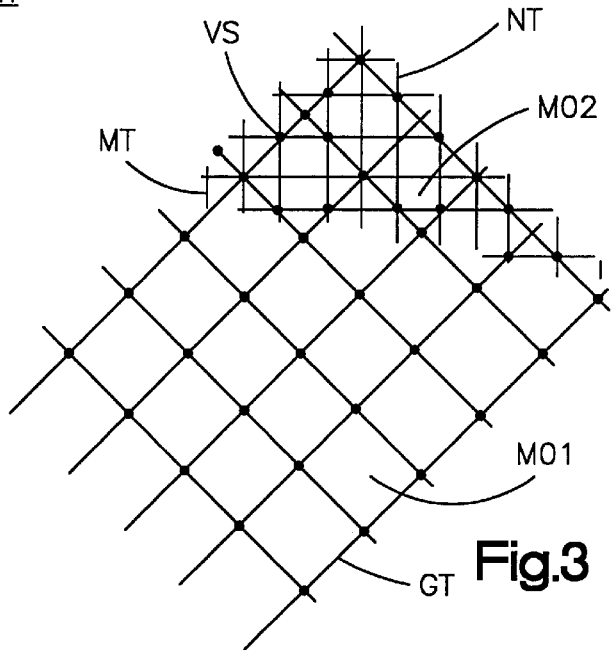
Figure 7:
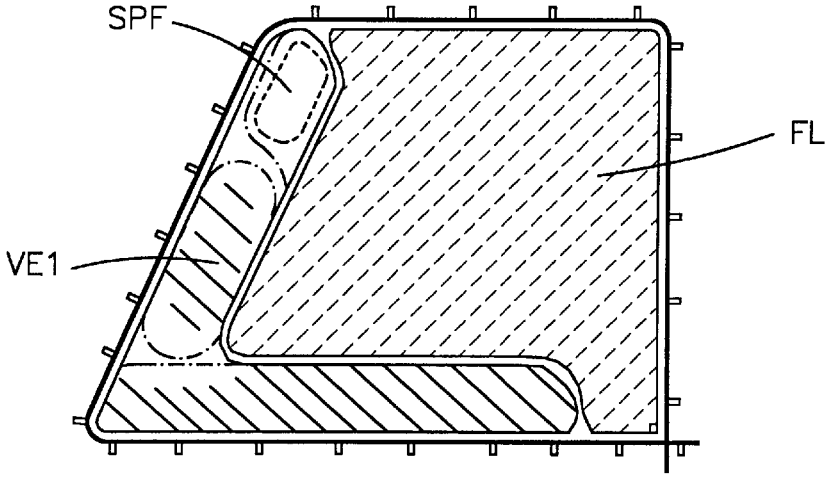
Figure 8:
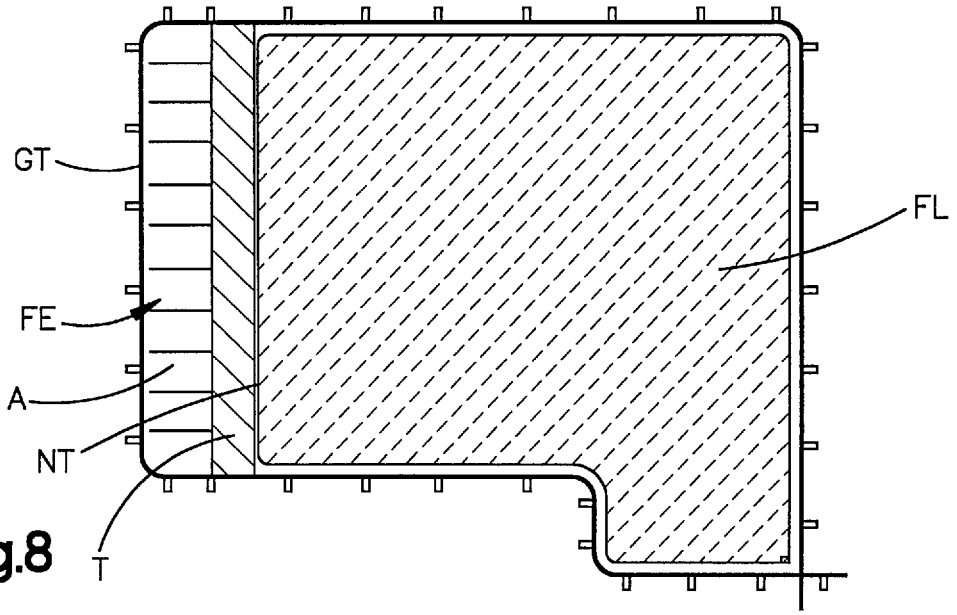
Figure 9:
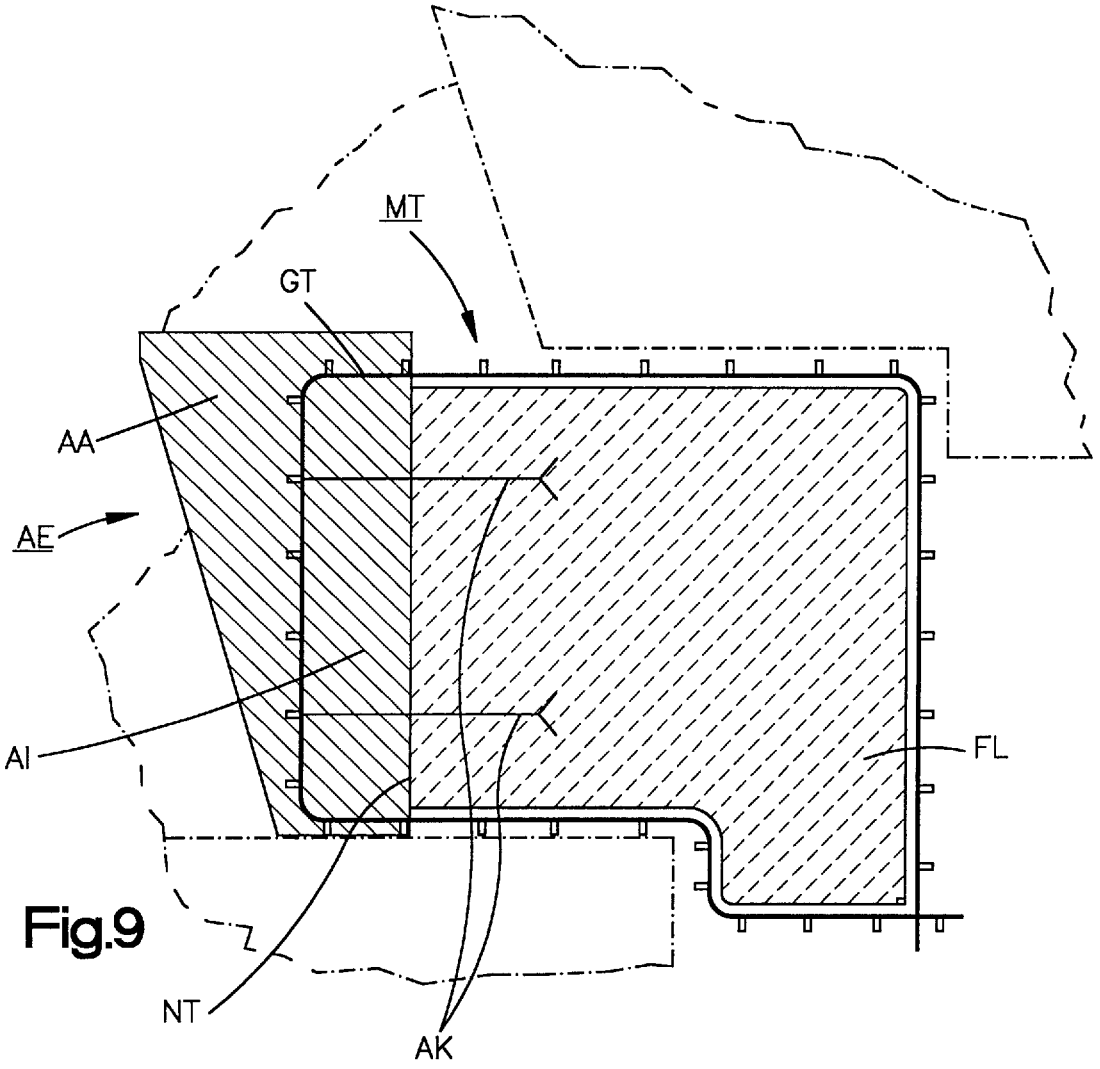
Figure 10:
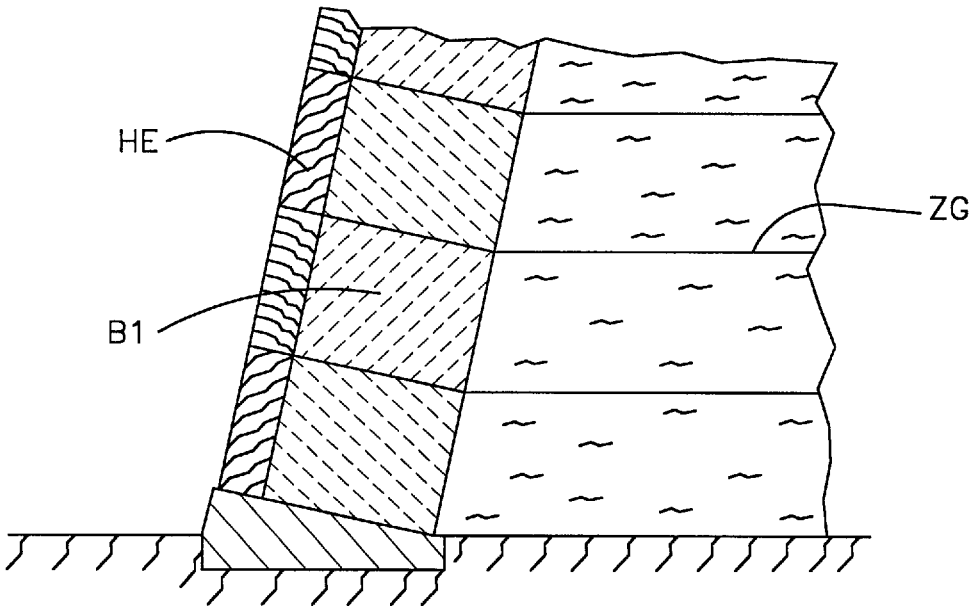
Figure 11:
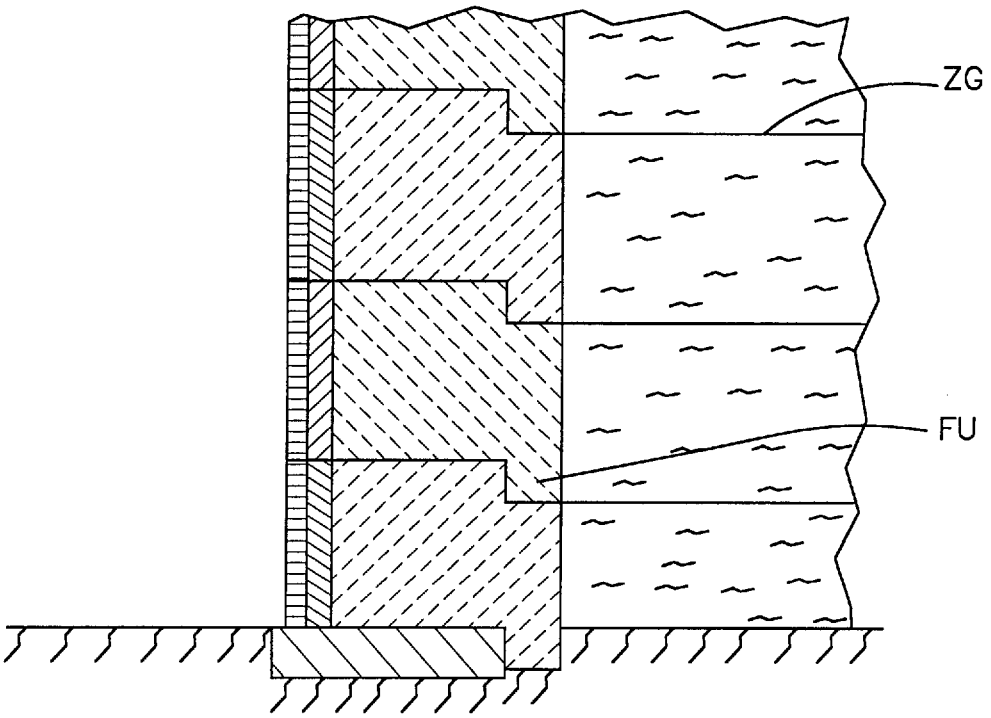
Figure 12:
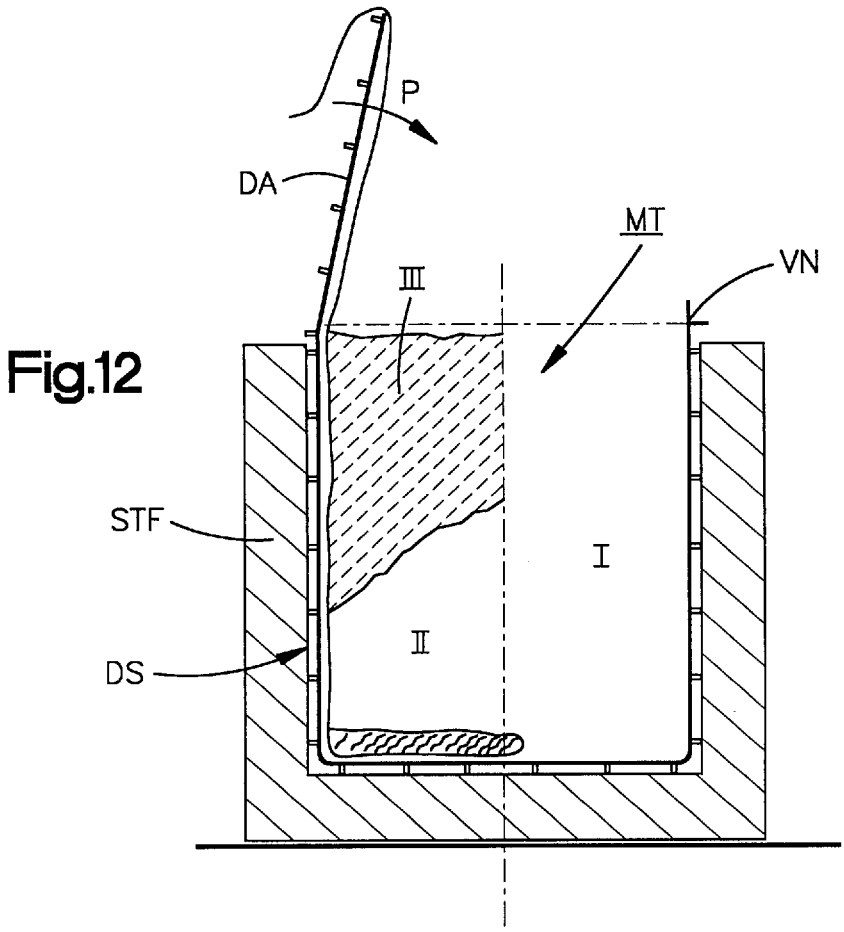
Figure 15:
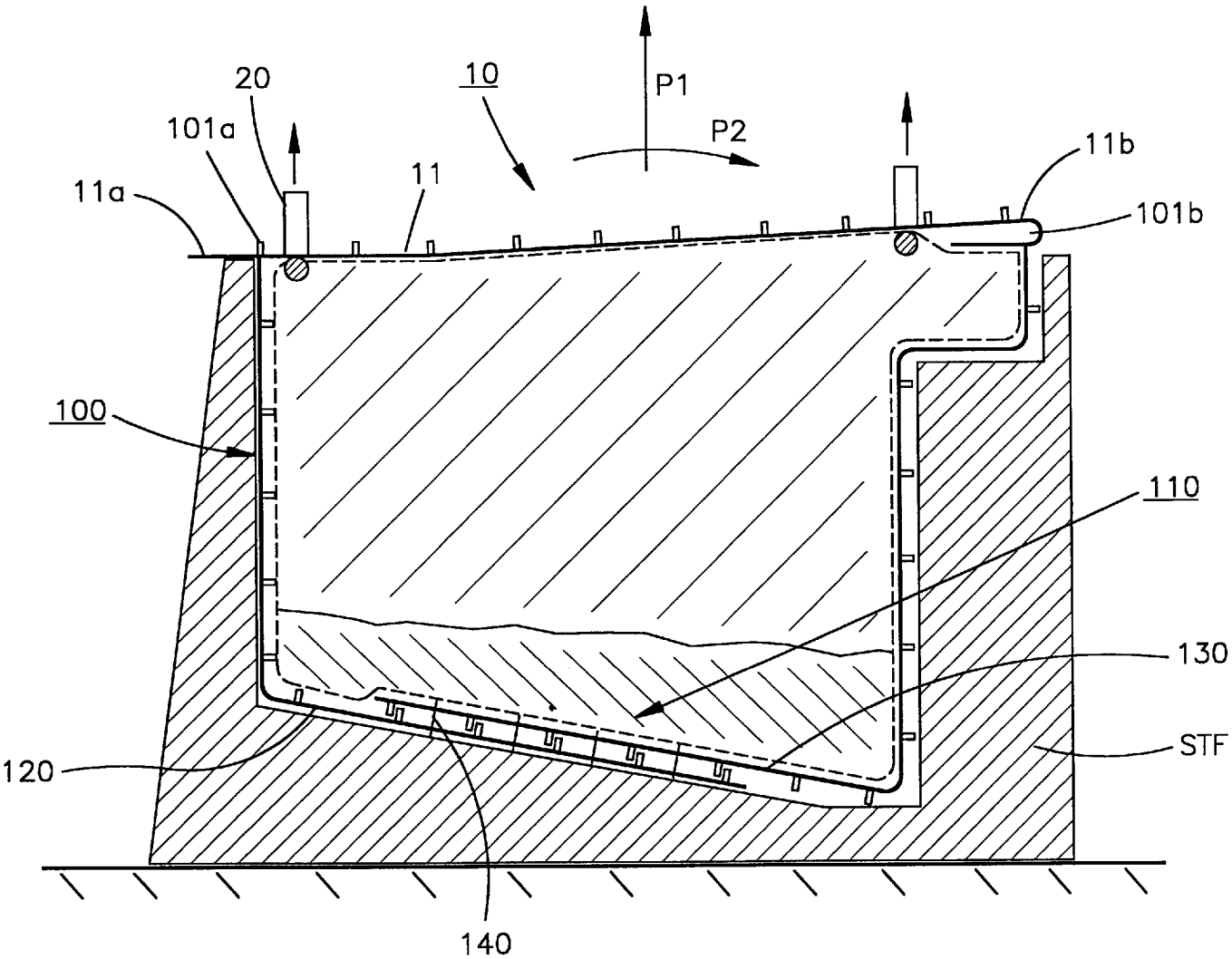
Figure 16:
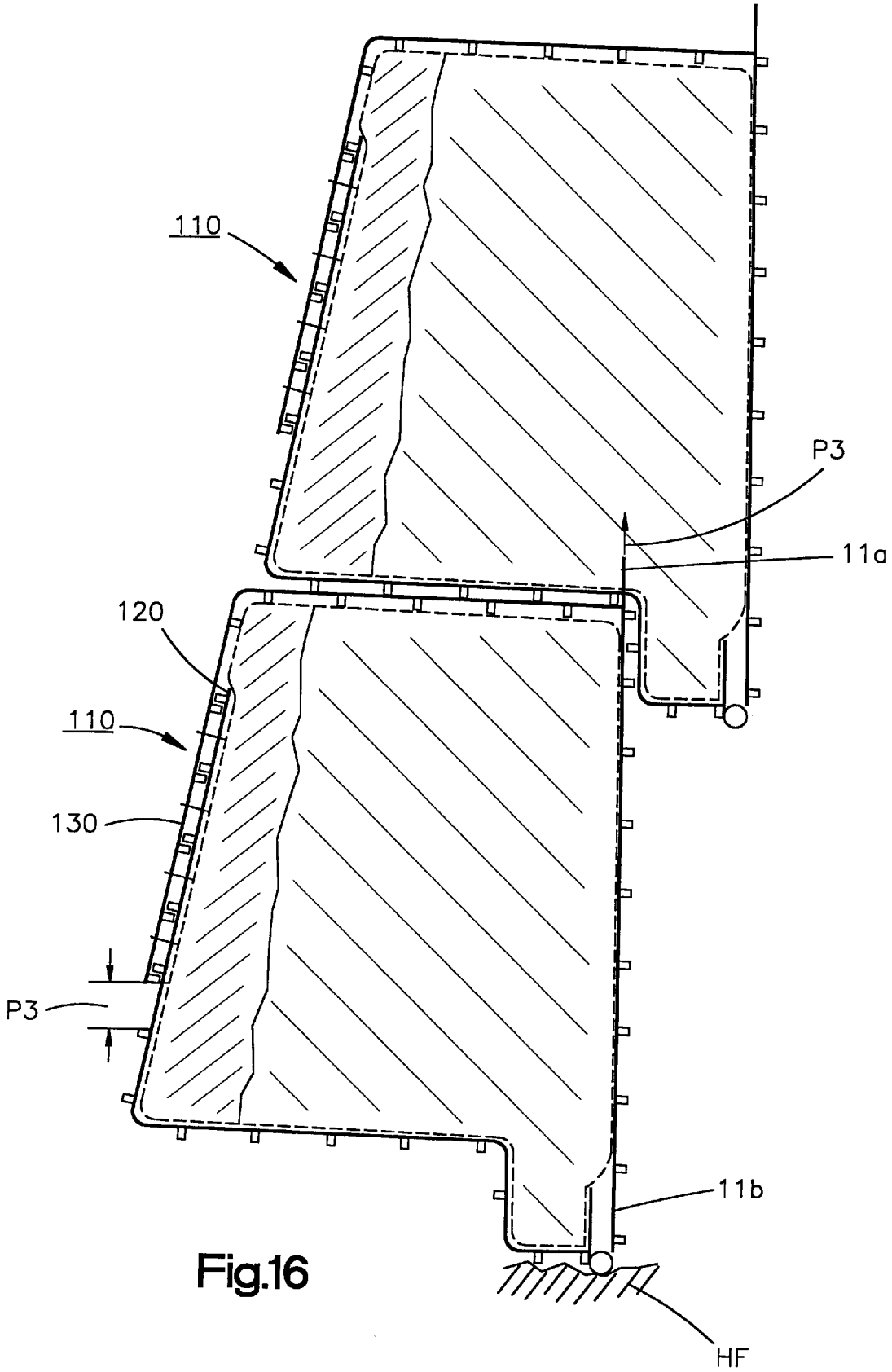
Figure 17:
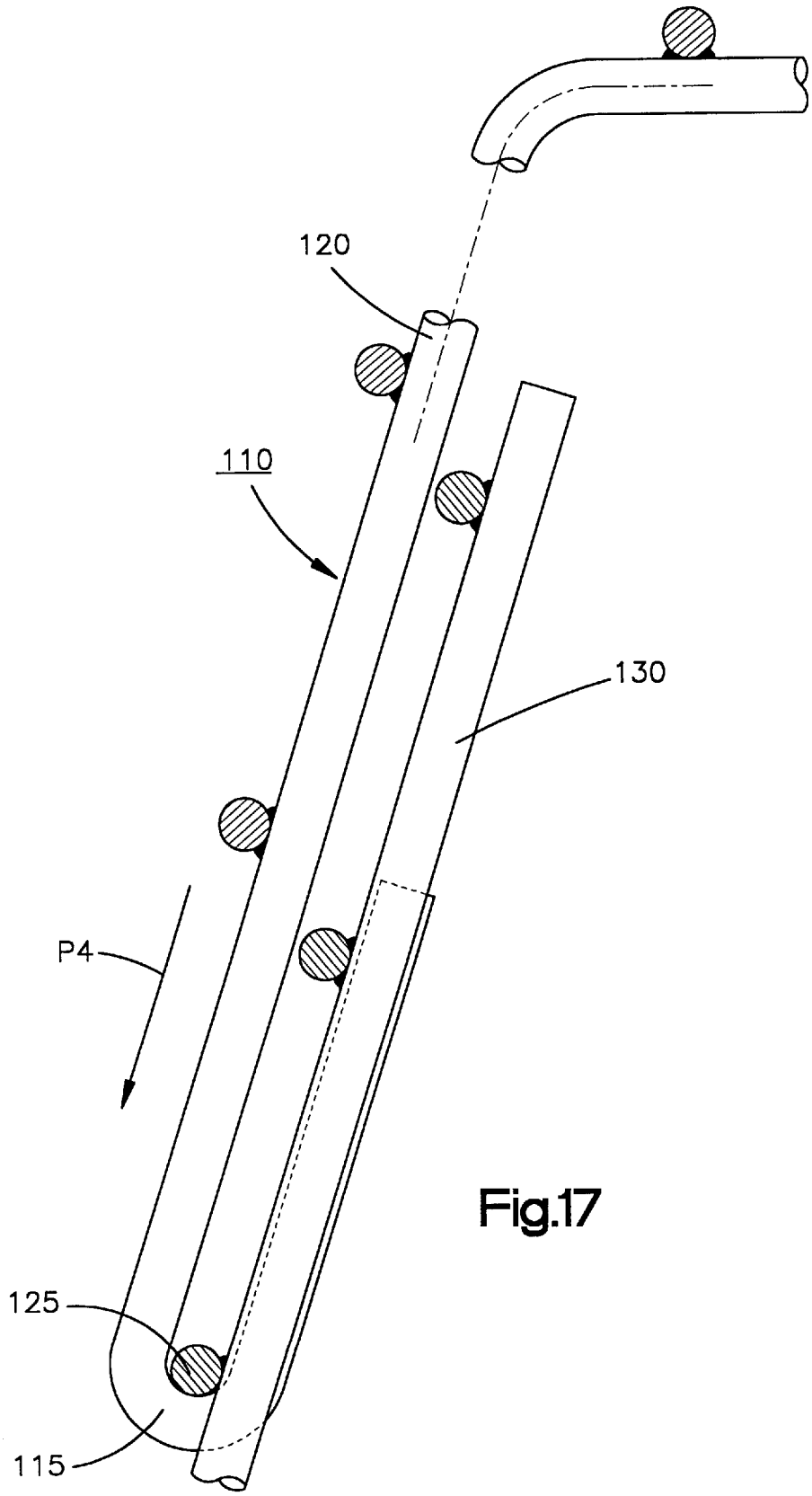
Figure 18:
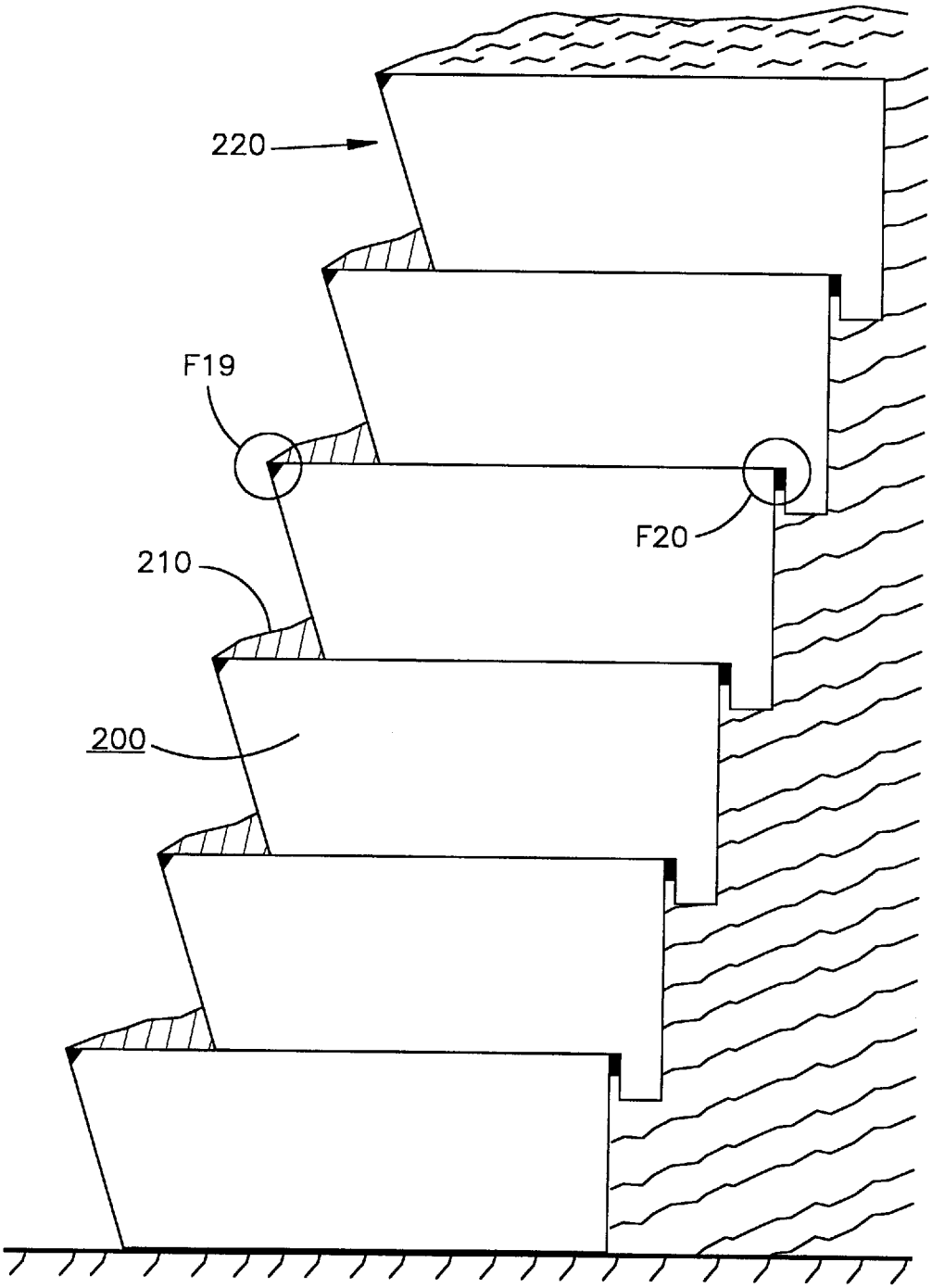
Figure 19:
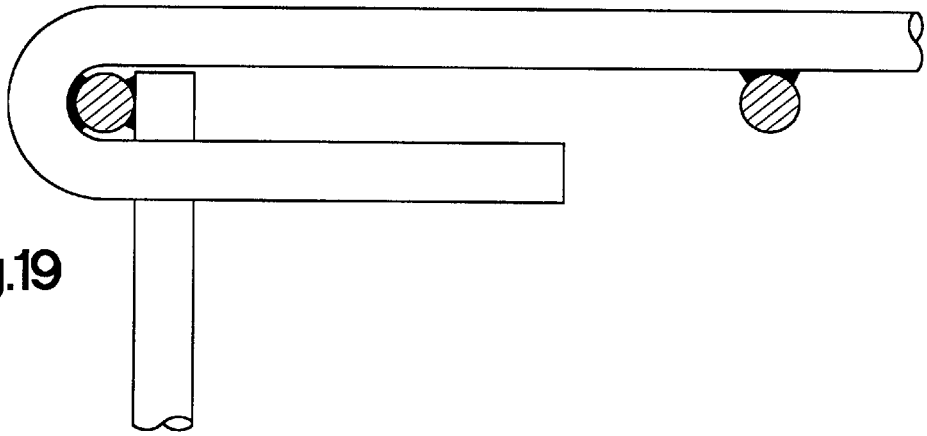
Figure 20:
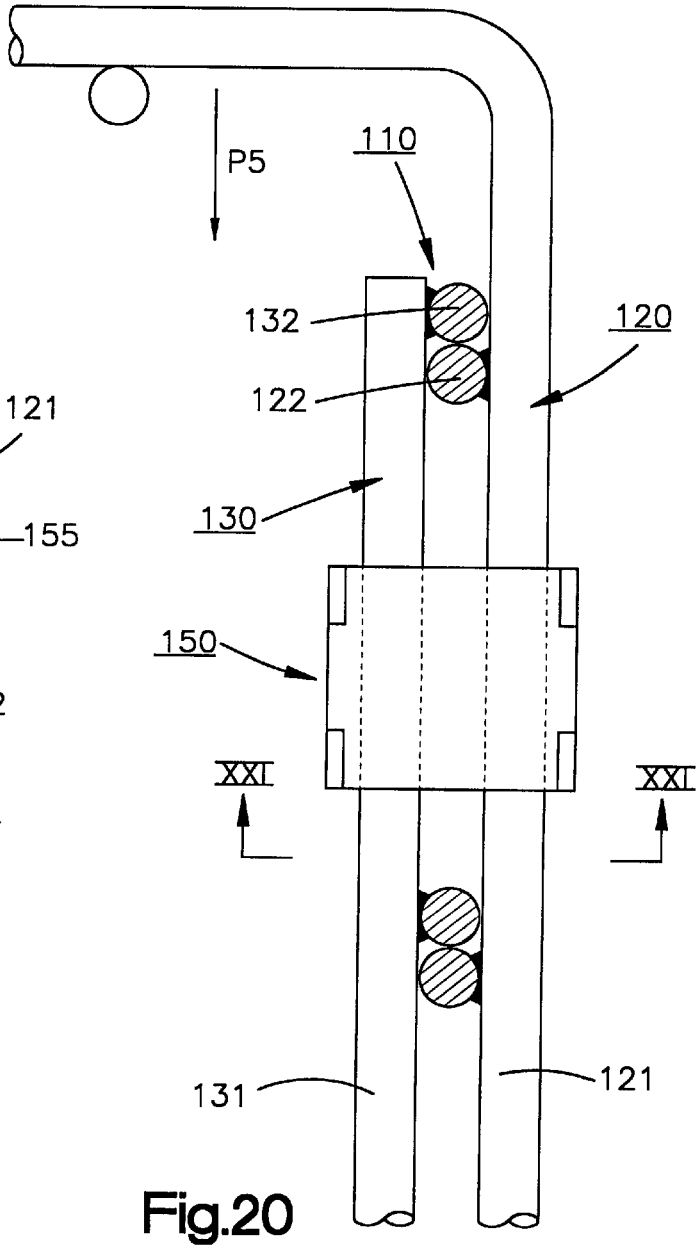

The invention will be explained in greater details with reference to the exemplified embodiments illustrated diagrammatically in the drawings, wherein:

FIG. 1 is a perspective partial view of a first embodiment of a structural element according to the invention, FIG. 2 is a cross-section of the structural element of FIG. I on a larger scale, FIG. 3, is a cut-out of a casing part with grating and netting part, FIG. 4 to FIG. 8 each illustrate another embodiment of a structural element according to the invention in cross-section, FIG. 9 is the cross-section of a structural element according to the invention with a cut-out of the front part of a retaining wall, FIG. 10 and FIG. 11 each show a cut-out of the front part of a retaining wall according to the invention, FIG. 12 to FIG. 11 each show in cross-section a structural element according to the invention being produced in a supporting mould to illustrate exemplified embodiments of production processes according to the invention, FIG. 16 shows a cut-out of a supporting or revetment structure made of structural parts of the type illustrated in FIG. 15, FIG. 17 is a view of an alternative casing wall which can be shortened, FIG. 18 is a vertical cross-section of a slope supporting wall made of structural elements modified compared to the type of FIG. 15, FIG. 19 and FIG. 20 each show on a larger scale the areas marked F19 and F20 in FIG. 18

Figure 21:
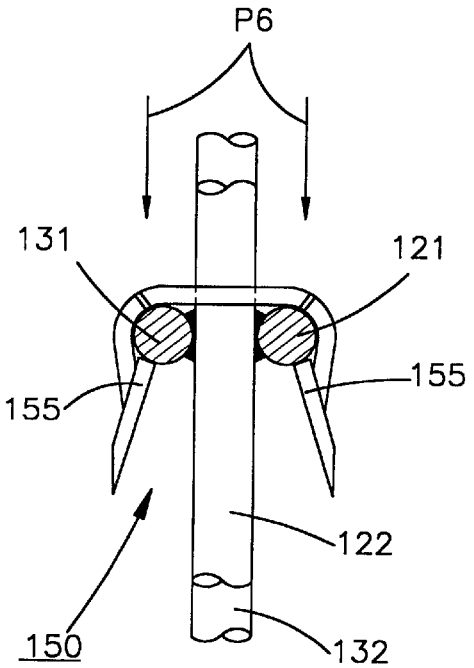

FIG. 21 shows a clamp element for the movable connection of grate bars in structural elements according to the invention.

FIG. 1 shows a beam-shaped structural element with a casing part MT , which consists of a substantially dimensionally stable grating part GT, preferably of galvanised steel wire, and an in relation to this grating part finer-meshed and more ductile netting part NT, here, for example, of geotextile or geofleece. The casing part consists here of a bottom U-section and an upper bridging element UE, which is connected to the long edges of the U-section—as indicated in FIG. 2—by, for example, seams VN. The casing part accordingly constitutes a closed hollow body, which in a force, form and/or material-locking bond with a filling FL forms a premanufactured and substantially self-supporting structural element.

Because of this construction and the choice of material, the casing part is at least partly permeable and accordingly allows the passing through of roots for a greening. At the same time the close-meshed netting part ensures a secure holding in position of a filling arranged inside the casing part, which filling comprises block-like and/or granular and/or pourable and/or porous material. The two layer elements of the casing part are connected to one another, with an at least partial overlapping of the surfaces, in a shear and/or tension resistant manner, e.g. as illustrated in FIG. 3, by gluing or by means of looping elements at the connection points VS. Indicated only diagrammatically in FIG. 3, on a larger scale, are the mesh openings MO2 of the netting part compared to the larger mesh openings MO1 of the grating part. If need be, several such layer elements may be connected to one another.

As also indicated in FIG. 3, the filling contains material SPF for planting, which is rich in humus and/or fertilizers and/or is provided with seeds and/or seedlings, put in during the premanufacture of the structural element, preferably in an area close to the surface. To this end the casing part which receives or holds the material containing the humus or fertilizers or seeds or seedlings, is made porous and/or sticky, at least in the area of an exposed surface. The material SPF may advantageously be arranged inside the casing part in the form of a flat, in particular plate or foil-shaped element, preferably comprising textile material or tangle-fiber fleece. Also provided in the filling is a section VA of at least partly dimensionally stable solidifying or hardening or already dimensionally stable hardened material, which forms a soil reinforcing element and preferably consists of an in comparison to the other filling material coarser grained, in particular block-like material.

The solidifying of the filling section VA can take place during a suitable interim stage of the production by adding cement, concrete, lime and/or bitumen. In this way a supporting or reinforcing element integrated in the structural element is formed. The example comprises, with special advantages with regard to the bending resistance and dimensional stability of the structural element, an elongated reinforcing element, which preferably extends at least approximately over a longitudinal extension of the structural element. In a similar manner, an arrangement of such a stiffening or reinforcing element can also be considered along the bottom, top and/or front of the structural element.

The casing part in the form of a closed hollow body together with a filling of a suitable material ensures a substantially self-supporting nature of the structural element already prior to the final solidification of a filling section provided with a binding agent, i.e. already in the installation state. This results in a problem-free handling and comparatively little labor during the erection of the structure. The solidifying filling section then unfolds its fill effect some time after the structural element has been installed in the wall, and also after a possible formation of a gap in the metal grating part due to damage or corrosion after a long time, it ensures a secure holding together of the structure with an adequate stability and carrying capacity.

Figure 4:
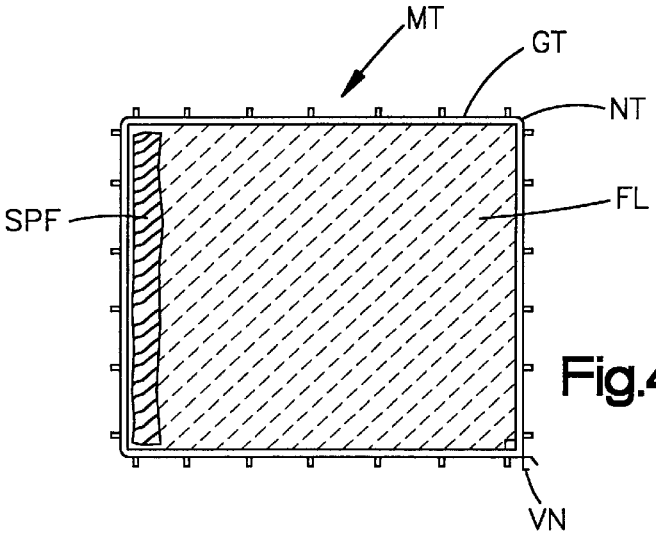

The structural element illustrated in FIG. 4 is characterized by a casing part with a grating part GT formed into a closed hollow body by just one longitudinal connecting seam VN, i.e. without separate bridging element. This aids a substantially self-supporting nature of the structural element, at the time of manufacture of the element.

Figure 5:
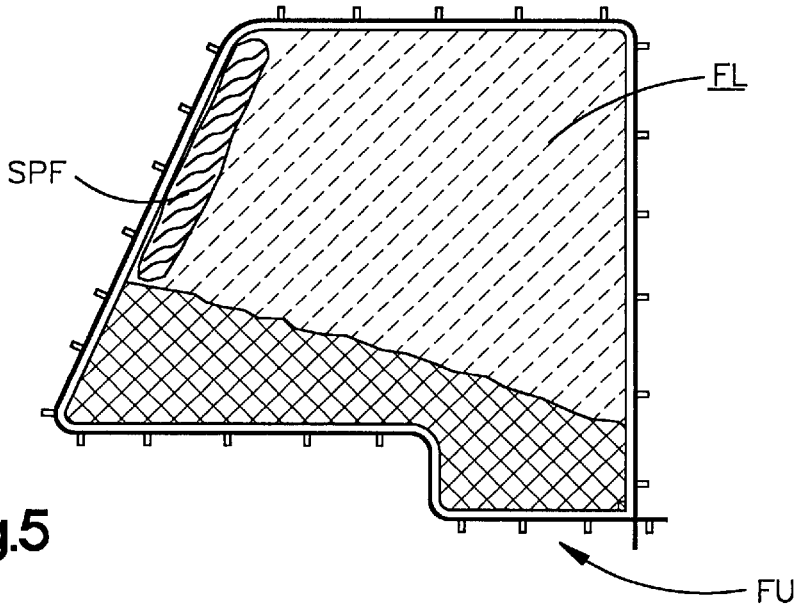

A special feature of the structural elements according to FIGS. 5, 6, 8 and 9 is a downwards projecting from element FU at the rear bottom part, which—as illustrated among others in FIG. 9—engages behind the rear upper edge of a structural element positioned underneath, thus ensuring a form-locking support and positional stability in respect of horizontal forces of the structural elements arranged on top of one another, in particular, for example, in respect of the soil pressure of the material present behind a retaining wall. As indicated in FIG. 5, inside the form element FU there is a filling section VA, which consists of a coarser, in particular block-like material, preferably, however, of a solidifying material or of a material which is already solidified in the installation state. This ensures a horizontal support of particularly great strength. The filling section VA extends, according to FIG. 5, over the bottom area up to the lower front edge of the structural element, so that on the whole an integrated reinforcing element with an angle section like cross-section of great strength is obtained.

Figure 6:
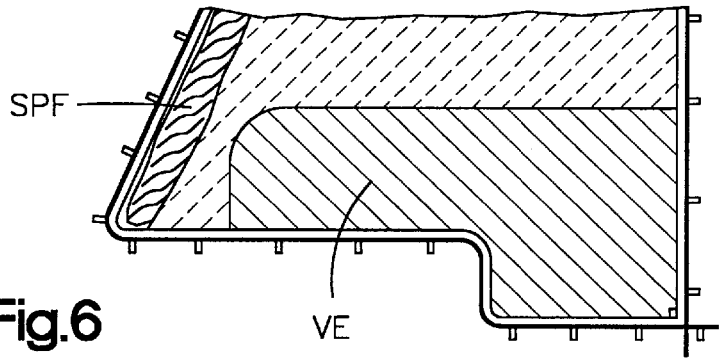

In this connection FIG. 6 shows a variant, wherein, in an arrangement similar to the filling section VA, a premanufactured angle profile reinforcing element VE is integrated into the structural element and its filling. In this connection FIG. 7 shows —here, for example, without form element FU—the construction of a premanufactured, integrated reinforcing element VEI in the form of a longitudinal bearer with an acute angle profile, the upper leg of which extends along the front of the structural element and ensures a particularly stable securing of the filling material if the front part of the casing were to disintegrate. As indicated as an alternative by dot-dash lines, a similarly effective reinforcing can also be obtained by means of two separate, flat elements. Also indicated by dot-dash lines in this embodiment is the possibility of creating, by reducing the cross-sectional height of the upper part of the reinforcing element in the upper part of the front of the structural element, space for a greening root element W.

The structural element according to FIG. 8 is destined for structures without a continuous front greening, but with high strength requirements. To this end the front part of the structural element is formed by a filling section FE arranged inside the grating part GT, but outside the netting part NT, which filling section FE consists of an inner carrying section T and an outer section A. During the premanufacture, the filling section FE is put into the grating part with the aid of a mould, whereupon the carrying section T made, for example, of concrete hardens, preferably prior to the installation. The outer section A may consist, for example, of a decorative material, e.g. laminated block material, and/or of a sound-proofing material such as expanded clay, expanded clay concrete and/or pumice stone concrete.

The structural element according to FIG. 9 is also destined for structures without a continuous front greening, but with high strength requirements. Here, at the front of the structural element, an outer element AE is provided, connected to the casing part MT in a form and/or material locking manner, in particular, in addition, by means of ties AK. The front section of the grating part GT is embedded in an inside section Al of the outer element AA and consists of a material of comparatively great strength, in particular solid concrete. The outer section AA of the outer element AE, on the other hand, consists preferably of a light material and/or decorative material and/or a material with a high sound absorption.

As examples of structures according to the invention, FIG. 10 and 11 show in cross-section walls for supporting slopes. It is understood, however, that corresponding constructions can also be used for other structures, e.g. free-standing sound-proofing and partitioning walls. For these, structural elements with suitably designed, in particular corresponding fronts and backs, can be arranged on top of one another in the form of a simple wall. in this case the depth of the structural elements is expediently chosen such that it decreases from the bottom upwards. Other structures consist of two structural elements, the backs of which rest against one another or are joined together, e.g. in a toothed arrangement. Also possible are individual walls, the backs of which face one another and between which a soil filling is provided.

The retaining wall according to FIG. 10 is a mass-supporting structure, the entire front of which can be greened, with at its back a slope that must be supported. It consists of cube-shaped or square structural elements B1 arranged on top of one another, which comprise an at least partly permeable casing part and a filling of block-like and/or granular and/or pourable and/or porous material. Some of the structural elements positioned on top of one another are joined to the slope by inserted tie rod elements ZG, preferably in the form of grating webs. The construction of the structural elements corresponds to the type according to FIG. 4, i.e. with a front that permits a growing through and a thick humus insert HE.

The retaining wall according to FIG. 11, on the other hand, represents an example without greening, possibly with structural elements according to FIG. 8. Near the back of at least some of the superposed structural elements, a downwards projecting form element FU is provided, which engages behind the rear upper edge of the structural element positioned underneath and provides a horizontal support in the manner already explained with reference to FIG. 9. In addition, this pairing of shapes constitutes a highly effective front fastening for the inserted tie rod elements ZG.

As can be noted from the foregoing explanations, a set of structural parts for making structures may comprise, in particular, square or beam-shaped structural elements with a preferably at least partly permeable casing part and with a filling which consists of block-like and/or granular and/or pourable and/or porous or solidified material. It furthermore comprises at least one anchoring element of a flexible material, to be arranged between superposed structural elements. Here, at the under and/or upper side of at least one of the structural elements, a deflecting and holding element (UH), complementary to the correspond surface section of the structural element positioned above or underneath it, in particular step or groove or wedge shaped, is provided for an anchoring element arranged between the structural elements.

An example of a production process according to the invention for structural elements of the type according to FIG. 4 and at the same time a production process according to the invention for corresponding structures, will now be explained with reference to FIG. 12.

First of all a trough like or U-shaped grating part GT with a cover section DA which is bent upwards but not yet swung in, is placed in a support mould STF. The result of this operation is indicated in the area I of FIG. 12. Then, as indicated in the area II, a netting part NT is placed in the grating part, and in the hollow profile casing part MT formed in this manner, in the area of the bottom front, a material SPF for planting, which is rich in humus and/or fertilizers and/or provided with seeds and/or seedlings, is put in. Then, as shown in area III of the figure, a filling material-possibly provided in sections with reinforcing means is put in and preferably compacted in layers. The open, upper side of the hollow profile casing part is now closed by bending in the cover section DA of the grating part as indicated by the arrow P. Then the hollow profile is closed by a connecting seam VN. Subsequently, the now premanufactured structural element is lifted out of the supporting mould by means of a crane and put into the installation position by turning it by 90° around a horizontal axis, i.e. with the side DS to the top. An important point that must be emphasized is that this work constitutes a premanufacture, i.e. operations which are carried out on the freely accessible object outside the place of installation and, therefore, permit a quick and less complicated procedure. On the other hand it is important that this premanufacture can be carried out with very simple means, in particular a simple supporting mould, in the direct vicinity of the place of installation, and together with the crane can be moved on as the construction work progresses, somewhat in the manner of a "flying" production site. Also the process according to the invention for the production of structures works in this manner.

Figure 13:
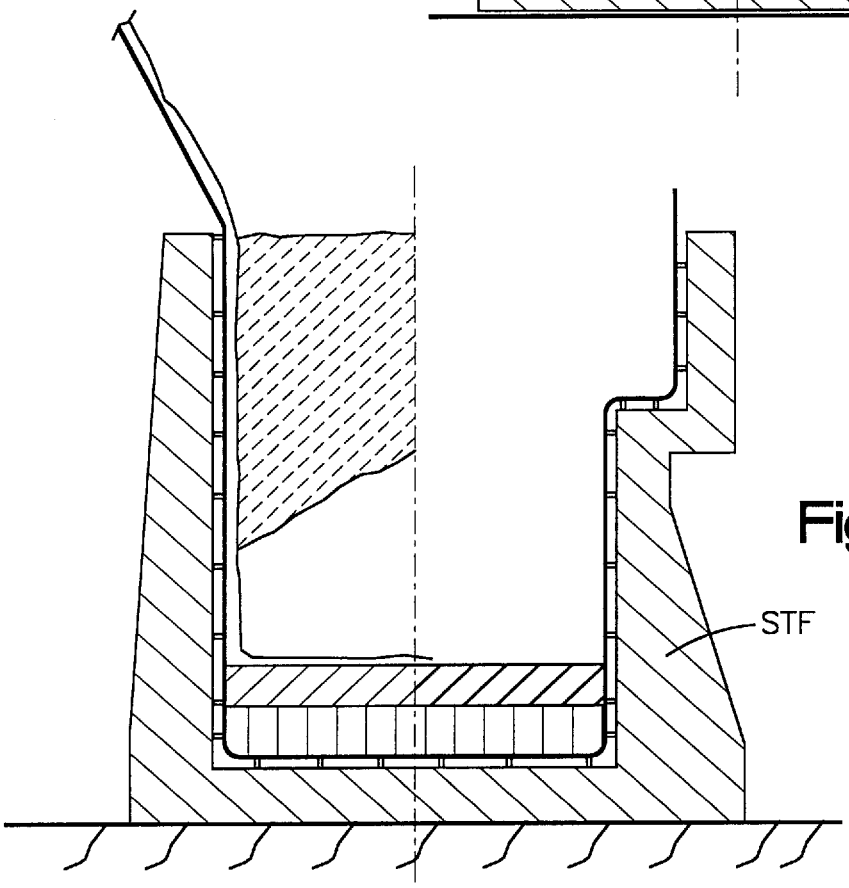
Figure 14:
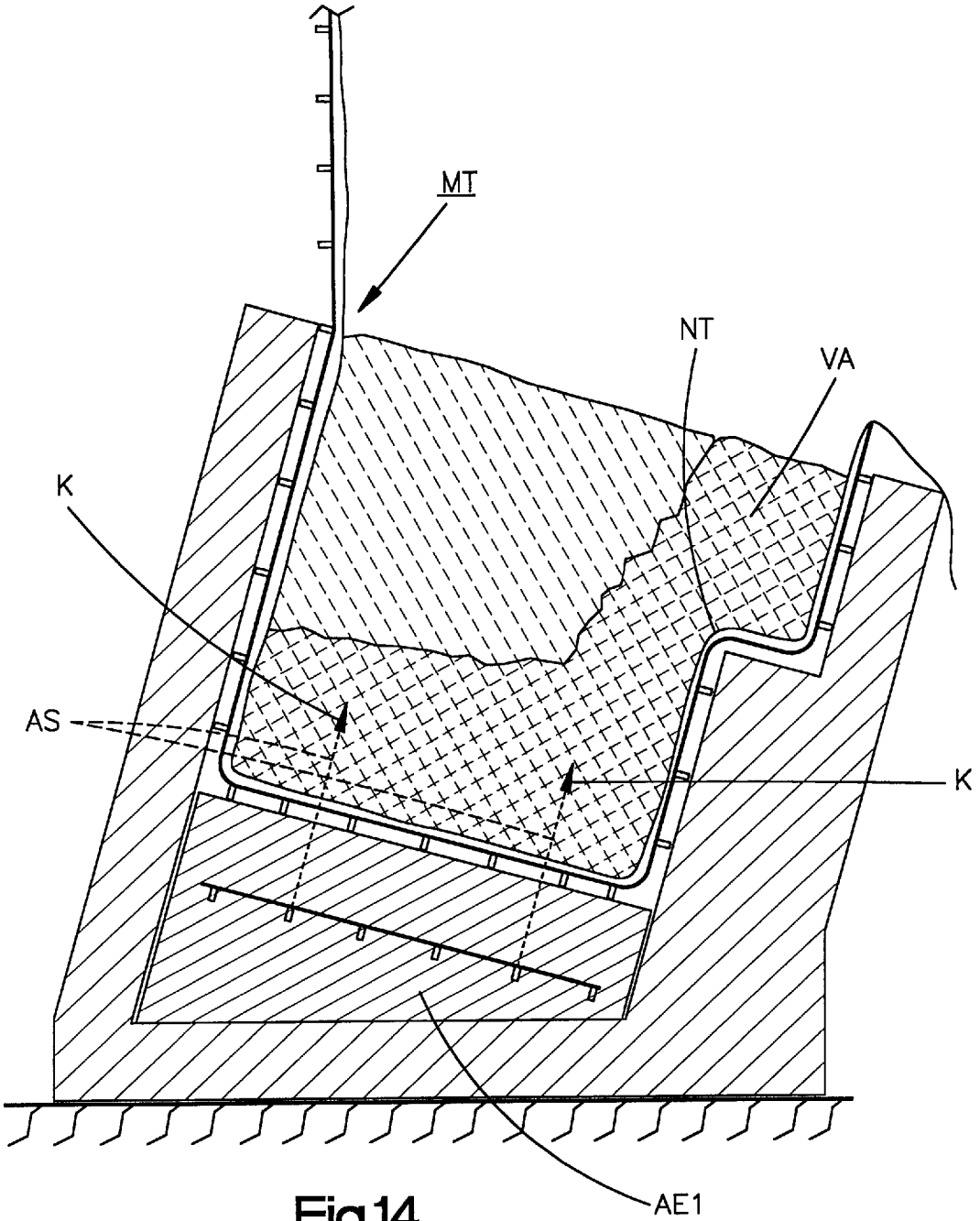

FIG. 13 shows an arrangement for the production of structural elements of the type according to FIG. 8 with a correspondingly adapted supporting mould STF. The same also applies to the arrangement of FIG. 14 with regard to the structural elements of the type according to FIG. 9, but with the following modification of the structural element construction: An outer element AEI is provided, which is arranged completely outside the casing part MT at its (here bottom) front and is connected to the filling FL by tie rods AS. The latter have pointed head parts K so that they can push through the inserted netting part, and engage into a solidified filling section VA, which in the manner of a double angle profile extends over the cross section of the hollow profile body. The illustrated slanted position facilitates the putting in of this filling section in the still doughy state.

For the already mentioned incorporation of solidifying material in the filling of structural elements according to the invention, the choice of material and the activating of the hardening or the introduction of the solidifying components takes place in such a way that the solidifying or hardening begins at least about 10 days after the activation or introduction. This avoids that the solidifying mass will be damaged during transport, but ensures in the course of the long use of the structure a high carrying capacity which will increase undisturbed until the final strength is reached, so that even a disintegration of the casing parts, which may occur in time due to corrosion, will not cause a loss of carrying capacity.

The structural element 10 illustrated in FIG. 15 in a supporting mould STF differs from the foregoing examples among others by the following features:

First of all at least one casing part 100 is provided, in the form of a non-buckling hollow body which is at least partly dimensionally stable in respect of bending forces, in particular in respect of compression forces acting in a casing plane. The casing part comprises at least one substantially flat wall 110, in particular at least a front or back wall which in relation to the installation position is arranged vertically or inclined in relation to the horizontal, which in the direction of the wall plane, in particular in relation to the installation position, is made such that, without buckling, it can be shortened vertically or in the direction inclined in relation to the horizontal. In the example this shortening possibility is obtained in that the wall 110 comprises at least two wall parts 120, 130 arranged parallel to one another and connected to one another in a movable manner parallel to the wall plane. The connection takes place here, for example, by means of binding loops 140. For the production procedure, the wall 110 is pulled out or pushed in to a size corresponding to the cavity of the mould, and placed in the cavity of the mould. After putting in the netting part and putting in and compacting the various filling components, the upper section of the netting is turned over—as already described in the foregoing—and the upper closing wall 11 of the casing part is moved in. This takes place by pushing the pointed, left end 11*a* of the corresponding grate bars of the wall 11 underneath the left upper bar 101*a* of the lower casing part, during which at the same time the U-shaped, right end part 11*b* is hooked in under the adjoining grate bar 101*b* of the lower casing part. Next, by means of the lifting gear 20, the structural part is lifted out and swung into the installation position in accordance with the arrows P1 and P2.

FIG. 16 shows a cut-out of a slope supporting or slope lining wall which is made of superposed structural elements according to FIG. 15. As can be noted, when putting on an upper structural element, the pointed grate bar end 11*a* penetrates through the netting part into the filling of the upper element, as a result of which, among others, also an advantageous, simple transverse locking into place of the structural elements is obtained. As the load increases when more structural elements are put on, and a corresponding compression as well as height reduction of the bottom structural element takes place, the front wall 110 can be shortened by the dimension P3 by pushing the two wall parts 120 and 130 together, whilst the height of the back wall decreases by the same dimension P3 due to the end 11*a* penetrating further into the filling. FIG. 17 shows an alternative construction which, as indicated by the arrow P4, also permits a shortening of the height of a casing part wall 110, here with the advantage that the difficult to attach binding loops fall away. This is achieved in a manner which can readily be noted from the illustration, by means of a U-shaped bending over of the ends 115 of the grate bars 120, which engage over the adjoining cross bar 125.

Important with this exemplified embodiment is that the wall 110 which can be shortened, comprises at least two parallel wall parts 120, 130 in the form of bar grates, wherein at least some of the grate bars 121, 131 of the two wall parts 120, 130 are in each instance arranged in pairs, adjoining one another and parallel to one another, and in such a way that they can be moved in relation to the longitudinal direction of the bar, but connected to one another at least substantially at a fixed distance.

FIG. 18 shows a slope supporting wall made of structural elements 200, which with regard to depth and inclination of the front are different from the type of FIG. 15. This embodiment shows that with the gabion-like structural elements according to the invention, by an in comparison to the structural part height considerably greater depth dimension, slope supporting walls of a great overall height and supporting carrying capacity can be produced. The outwards extending inclination of the front walls of the structural elements, in addition to the greening areas 220 present therein, provides farther, comparatively weakly inclined and therefore growth-friendly greening areas 210.

The areas marked F19 and F20 in FIG. 18 are shown on a larger scale in FIGS. 19 and 20. FIG. 19 shows the quite understandable use of U-shaped grate bar ends similar to FIG. 17 for an edge connection between casing grates arranged at an angle to one another. FIG. 20 shows a movable, but distance-securing connection between the vertical bars 121 and 131 of the grate walls 120 and 130, respectively, of a casing section 110 by means of a clamp-like spring locking element 150, which in FIG. 21 is illustrated in section along the plane XXI—XXI. Within the limits determined by the vertical distances between the horizontal bars 122 and 132 respectively of the grate walls 120 and 130, a vertical moving of the two grate walls is possible which, for example, corresponds to a height reduction of the casing section 110 as indicated by the arrow P5. As can be noted from FIG. 21, the spring locking element 150 can be pushed in the direction of the arrows P6 by exerting a suitable pressure by way of the vertical bars 121, 132 arranged on either side of the horizontal bars 122, 132, during which the spring legs 155 jump behind the bars 121, 131 and result in a self-holding, form-locking distance securing.

It is claimed:

1. A building element for a structure such as a greenable supporting or sound-proofing structure, said building element comprising an at least partly permeable casing part and a filling which comprises block-like or granular or pourable or porous material, characterized by:

said casing part (100) having the form of a non-buckling hollow body which is at least partly rigid in respect of bending forces, in particular in respect of compression forces acting in a casing plane, and which in a bond with said filling forms a premanufactured and substantially self-supporting building element;

said casing part comprising at least one generally flat wall (110), in particular at least one side wall which extends in a direction vertically or transverse to the horizontal when said building element is installed, which wall is shortenable, without buckling, in said direction vertically or transverse to the horizontal.

2. A building element according to claim 1, characterized in that said wall (110) which is shortenable comprises at least two wall parts (120, 130) extending parallel to one another and connected for movement relative to each other in a direction parallel to the wall plane.

3. A building element according to claim 2, characterized in that said wall (110) which is shortenable comprises at least two wall parts (120, 130) in the form of grate bars, extending parallel to one another, and in that at least some of the grate bars (121, 131) of the two wall parts (120, 130) are in each instance arranged in pairs, adjacent to one another and extending parallel to one another, as well as movable in relation to the longitudinal direction of the bar, connected to one another at a fixed distance.

4. A building element according to claim 2, characterized in that said wall parts (120, 130) movable in a direction parallel to one another are connected to one another by binding loops (140) or clamp elements (150) in the form of catch-spring clamps.

5. A building element for a structure such as a greenable supporting or sound-proofing structure, said building element comprising an at least partly permeable casing part and a filling which comprises block-like or granular or pourable or porous material, characterized by:

said casing part (MT) comprising an at least partially rigid grating part (GT) and a netting part (NT) at least portions of said netting part being finer-meshed and more ductile then said grating part and being flexible; and said casing part having the form of a longitudinally extending, closed hollow body having a multi-angular cross-sectional configuration and having edges extending in said longitudinal direction, said edges being formed by pairs of abutting wall sections of said casing part;

all edge portions of said closed hollow body being positively connected with each other so as to resist bending or torsion of said longitudinally extending hollow body, said grating part together with said netting part and said filling forming a premanufactured and substantially self-supporting building element;

characterized in that at least one supporting or reinforcing element (VA, FE) internally integrated in the building element is provided.

6. A building element for a structure such as a greenable supporting or sound-proofing structure, said building element comprising an at least partly permeable casing part and a filling which comprises block-like or granular or pourable or porous material, characterized by:

said casing part (MT) comprising an at least partially rigid grating part (GT) and a netting part (NT) at least portions of said netting part being finer-meshed and more ductile then said grating part and being flexible; and said casing part having the form of a longitudinally extending, closed hollow body having a multi-angular cross-sectional configuration and having edges extending in said longitudinal direction, said edges being formed by pairs of abutting wall sections of said casing part;

all edge portions of said closed hollow body being positively connected with each other so as to resist bending or torsion of said longitudinally extending hollow body, said grating part together with said netting part and said filling forming a premanufactured and substantially self-supporting building element;

characterized by an elongate cross-sectional configuration, and comprising at least one internal supporting or reinforcing element which extends along at least one surface area, in particular along the bottom, top or front area, as well as extends at least partially over the longitudinal extent of said building element.

7. A building element for a structure such as a greenable supporting or sound-proofing structure, said building element comprising an at least partly permeable casing part and a filling which comprises block-like or granular or pourable or porous material, characterized by:

said casing part (MT) comprising an at least partially rigid grating part (GT) and a netting part (NT) at least portions of said netting part being finer-meshed and more ductile then said grating part and being flexible; and said casing part having the form of a longitudinally extending, closed hollow body having a multi-angular cross-sectional configuration and having edges extending in said longitudinal direction, said edges being formed by pairs of abutting wall sections of said casing part;

all edge portions of said closed hollow body being positively connected with each other so as to resist bending or torsion of said longitudinally extending hollow body, said grating part together with said netting part and said filling forming a premanufactured and substantially self-supporting building element;

in which the rear bottom region of said casing part is formed as a downwards projecting form element provided with solidified or solidifying material.

8. A building element for a structure such as a greenable supporting or sound-proofing structure, said building element comprising an at least partly permeable casing part and a filling which comprises block-like or granular or pourable or porous material, characterized by:

said casing part (MT) comprising an at least partially rigid grating part (GT) and a netting part (NT) at least portions of said netting part being finer-meshed and more ductile then said grating part and being flexible; and said casing part having the form of a longitudinally extending, closed hollow body having a multi-angular cross-sectional configuration and having edges extending in said longitudinal direction, said edges being formed by pairs of abutting wall sections of said casing part;

all edge portions of said closed hollow body being positively connected with each other so as to resist bending or torsion of said longitudinally extending hollow body, said grating part together with said netting part and said filling forming a premanufactured and substantially self-supporting building element;

characterized in that at least one plate-shaped (A1, A2) internal supporting or reinforcing element is provided in said casing part.

9. A building element for a structure such as a greenable supporting or sound-proofing structure, said building element comprising an at least partly permeable casing part and a filling which comprises block-like or granular or pourable or porous material, characterized by:

said casing part (MT) comprising an at least partially rigid grating part (GT) and a netting part (NT), at least portions of said netting part being finer-meshed and more ductile then said grating part and being flexible; and said casing part having the form of a closed hollow body, which, together with said filling (FL), forms a premanufactured and substantially self-supporting building element;

said filling containing material that is solidified or solidifies by activation, in particular by introducing cement, concrete, lime or bitumen, in particular a material the solidification or hardening of which begins at least about 10 days after the activation or introduction.

10. A building element for a structure such as a greenable supporting or sound-proofing structure, said building element comprising an at least partly permeable casing part and a filling which comprises block-like or granular or pourable or porous material, said filling (FL) comprising at least one section of at least partially rigid material;

said filling containing material that is solidified or solidifies by activation, in particular by introducing cement, concrete, lime or bitumen, in particular a material the solidification or hardening of which begins at least about 10 days after the activation or introduction.

11. A building element for a structure such as a greenable supporting or sound-proofing structure, said building element comprising an at least partly permeable casing part and a filling which comprises block-like or granular or pourable or porous material, characterized by at least one outer element (AE) which is locked to said casing part (MT) in the area of at least one outer surface section, of said building element;

said filling containing material that is solidified or solidifies by activation, in particular by introducing cement, concrete, lime or bitumen, in particular a material the solidification or hardening of which begins at least about 10 days after the activation or introduction.

12. A method of making a beam shaped building element for a mass-supporting structure such as a greenable supporting or sound-proofing structure, the building element including an at least partially permeable casing part and a filling which comprises block-like or granular or pourable or porous material, or solidified or solidifying material, characterized by the following steps:

forming a hollow section casing part with an open side by (a) placing in a suitable supporting mould (STF) grating parts made of a grate-like, at least partially rigid flat material having a trough-like configuration and (b) placing in the grating part at least one netting part (NT) of a flexible flat material which is permeable or perforated at least in sections;

putting into the hollow section casing part the filling material which may contain a solidifying agent and compacting the filling material in layers; and closing the open side of the hollow section casing part by putting on or bending in at least one bridging element (UE) or grating part cover (DA).

13. A method according to claim 12, characterized in that said step of putting a filling material into the hollow section casing part comprises the step of filling the hollow section casing part with its front disposed at the bottom, and comprising the further step of rotating the filled casing part about a longitudinal axis by about 90° prior to the installation of the building element in the structure.

* * * * *